United States Patent [19]

Oboler et al.

[11] Patent Number: 4,674,242

[45] Date of Patent: Jun. 23, 1987

[54] FASTENER STUD FOR ACCOMMODATION OF DRYWALL TO INNER WALL AND CEILING SURFACES

[75] Inventors: Leonard Oboler, Key Biscayne; John M. Schram, Melbourne Beach, both of Fla.

[73] Assignee: High Tech Homes, Inc., Coral Gables, Fla.

[21] Appl. No.: 900,897

[22] Filed: Aug. 27, 1986

[51] Int. Cl.[4] ..... E04B 7/02; E04B 5/16

[52] U.S. Cl. ..... 52/91; 52/309.7; 52/309.12; 52/324; 52/327; 52/441

[58] Field of Search ..... 52/91, 309.7, 309.12, 52/324, 327, 405, 441

[56] References Cited

U.S. PATENT DOCUMENTS

| | | | |
|---|---|---|---|
| 2,249,073 | 7/1941 | Williamson | 52/405 X |
| 4,291,513 | 9/1981 | Ankarswed | 52/405 X |
| 4,455,793 | 6/1984 | Nania | 52/91 |
| 4,512,126 | 4/1985 | Walston | 52/309.12 X |

FOREIGN PATENT DOCUMENTS

| | | | |
|---|---|---|---|
| K20453V/37b | 12/1956 | Fed. Rep. of Germany | 52/441 |
| 531387 | 10/1921 | France | 52/324 |
| 734014 | 7/1955 | United Kingdom | 52/324 |

*Primary Examiner*—Alfred C. Perham

*Attorney, Agent, or Firm*—Richard P. Matthews

[57] ABSTRACT

A special stud which permits drywall installation on walls and ceiling surfaces independent of the structural qualities of the synthetic plastic material used in building panels. A stud member is positioned between adjacent building panel members which are preformed to form conduits in both the wall and ceiling members. Male attaching members such as lag screws or nails are partially inserted into the stud members so that their heads remain in the conduits to permit fastening thereto of column or roof beam structural steel members as well as rebar members. Furring strip members may be attached to the inside of the studs so that drywall members may be attached to the furring strip members.

8 Claims, 4 Drawing Figures

FASTENER STUD FOR ACCOMMODATION OF DRYWALL TO INNER WALL AND CEILING SURFACES

This invention relates to building construction and, more particularly, to the use of a fastener stud for accommodation of drywall to inner wall and ceiling surfaces independently of the structural qualities of any synthetic plastic material used in the manufacture of building panels.

BACKGROUND OF THE INVENTION

Heretofore, it has been known to use building panels made from synthetic plastic materials in the manufacture of houses. One of these materials, expanded polystyrene, has proven to be a valuable insulation means for conserving energy when installed, so as to form an envelope surrounding an enclosed residential volume. Because the expanded polystyrene has a very low melting point, this material will be transformed into a vapor when exposed to temperatures above 200° F., and it is necessary to cover all exposed expanded polystyrene surfaces with gypsum wallboard or sprayed plaster or concrete in order to assure that in the event of a fire, the material will withstand heat for a sufficient period of time to allow occupants to vacate the building. If the wallboard or plastered surfaces are adhered to the polystyrene, transmission of heat through these surfaces will eventually cause the expanded polystyrene to melt, and the surfacing materials will then fall away from the walls and ceiling surfaces.

SUMMARY OF THE INVENTION

In accordance with the present invention, the foregoing limitations on the use of a low melting point synthetic plastic material in the manufacture of wall and ceiling building panel members has been effectively overcome. In particular, a stud is positioned between adjacent building panel members and anchored to the reinforced concrete structure. Therefore, the stud will remain in place regardless of the condition of the synthetic plastic material in the building panel with which it is in contact. Illustrative anchoring means include lag screws, angled or straight nails, or wire elements fastened to the stud.

The lag screws or nails can be set with their protruding heads at a fixed or predetermined distance such that the column or roof beam structural steel members may be fastened thereon. These members are shown in greater detail in Leonard Oboler's copending application now U.S. Pat. No. 4,625,484, which issued Dec. 2, 1986. The outer surface mesh reinforcing or rebar reinforcing can also be attached to the protruding heads.

The inner surface of the stud can receive either the drywall sheets, which may now be nailed directly to the studs, or may have installed thereon furring strip means in the form of sheet metal or wood nailers to which the drywall may be attached by conventional methods.

The lateral sides of the stud may also be equipped with gang nails or other fastening means which serve to align the expanded polystyrene accurately, thereby facilitating the erection process.

Also by nailing a plate-like member along the upper surface of the studs, enables the pre-fabrication of wall elements and also allows the nailing of similar studs in the ceiling assembly to previously placed wall elements.

The inherent advantages and improvements of the present invention will become more readily apparent upon reference to the following detailed description of the invention and by reference to the attached drawings wherein.

DETAILED DESCRIPTION OF THE INVENTION

Figure 1:
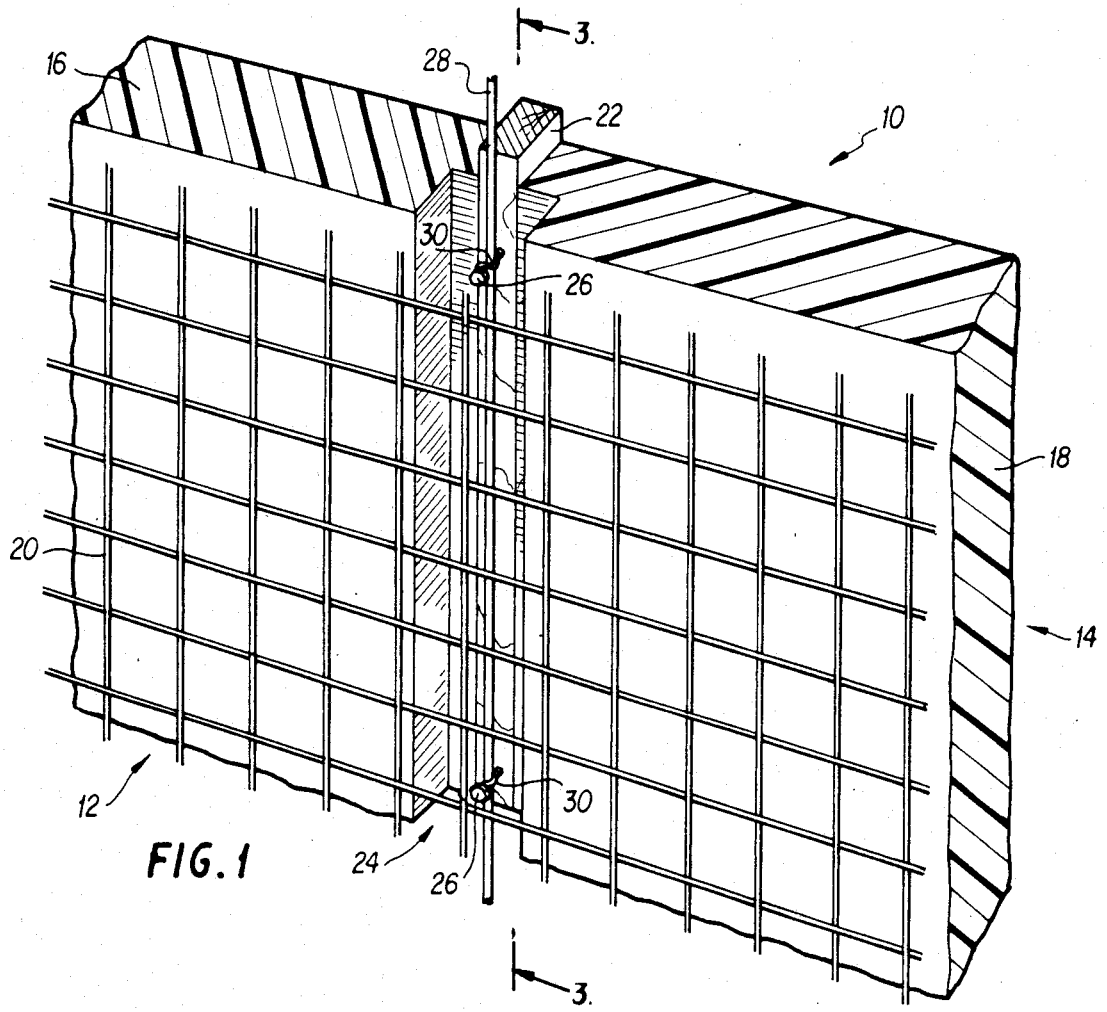
FIG. 1 is a fragmentary perspective view of an exterior portion of a wall structure made in accordance with the present invention.

Referring now to FIG. 1 of the drawings, there is illustrated a section of a wall, indicated generally at 10, which includes portions of adjacent wall panel members indicated generally at 12 and 14. Wall panel members 12, 14 are made from synthetic plastic material such as expanded polystyrene 16, 18. A reinforcing mesh 20 is secured to the front face of wall 10 in a manner to be described hereinafter.

In order to accommodate the expanded polystyrene to local fire codes by providing a dry wall installation on walls and ceiling surfaces independent of the structural qualities of the expanded polystyrene, a stud member 22 is positioned between adjacent building panel members 12, 14. The adjacent panels 12, 14 form a conduit 24 by being grooved in the manner more fully described in U.S. Pat. No. 4,625,484. Male attaching members 26 are driven into stud **22*a* with the heads thereof extending a fixed and predetermined distance into conduit 24 formed between adjacent wall panel members 12, 14. This permits rebar members 28 to be secured to the heads of lag screws 26 by being tied thereto by tie members 30**.

Figure 2:
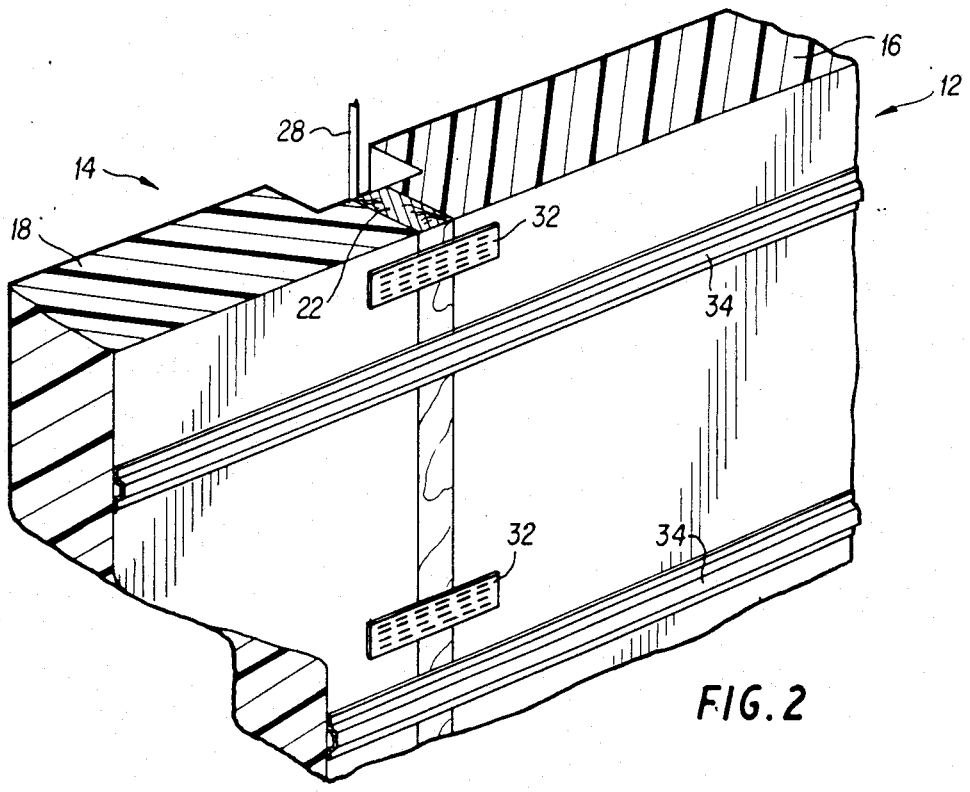
FIG. 2 is a fragmentary perspective view of the inside of the wall structure of FIG. 1.

Referring now to FIG. 2, gang nailers 32 are provided on the inside wall of wall panel members 12, 14 and secured to the stud member 22. Furring strip means 34 are also secured to the stud member 22. These furring strip means can take the form of conventional wooden strips or metal hi-hat members with the latter being shown in FIG. 2. Gypsum wall board 38 or the like are attached to the furring strip means 34 as is illustrated in FIGS. 3 and 4.

Figure 3:
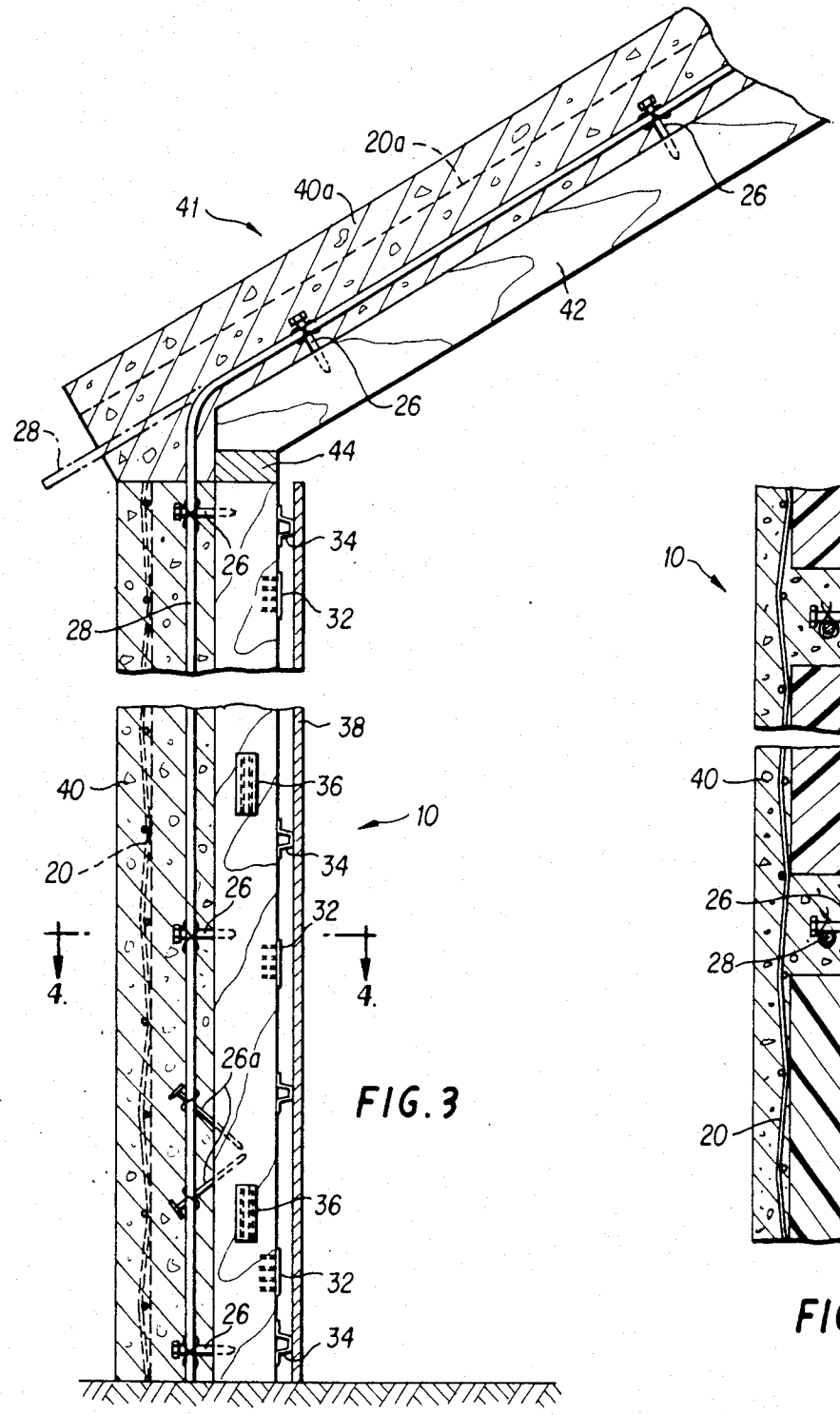
FIG. 3 is a fragmentary elevational view as seen in vertical cross section along line 3—3 of FIG. 1.
Figure 4:
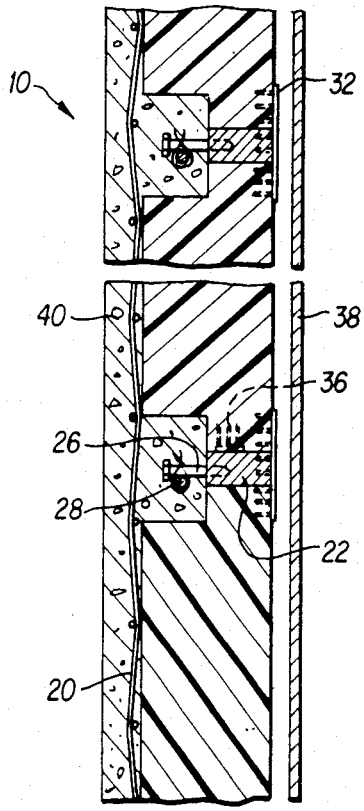
FIG. 4 is a plan view taken in horizontal cross section along line 4—4 of FIG. 3.

Referring now to FIG. 3, the use of additional gang nailers 36 on the lateral sides of the stud 22 serve to align the expanded polystyrene accurately, thereby facilitating the erection process. FIG. 3 also illustrates an alternative to the lag screws 26 in the form of nails **26*a* which may be driven in straight or angled as illustrated in FIG. 3. In each case, the heads of the nails are displaced from the inside of the stud 22 to permit the securement of rebar members 28 by tie members 30**.

FIG. 3 also illustrates the further steps in the completion of the wall and roof structure by the implacement of concrete at 40 in the wall and at **40*a* on the roof which is indicated generally at 41. This is preferably effected pneumatically by a process known as Gunniting. FIG. 3 illustrates that the rebar members 28 are continued directly from the wall 10 to the roof 41 by being bent to conform to the slope of the roof. The groove 24 in the wall member 10 is continued into the roof structure by aligning stud members 42 on the roof with the stud members in the wall 10. It is preferred to use 2×6 members as the studs on the roof as compared with 2×4 stud members in the wall 10**.

FIG. 3 also illustrates a plate-like member 44 which is positioned horizontally along the upper surface of the studs of the wall to enable prefabrication of wall elements and also to allow nailing of similar studs 42 in the ceiling assembly to previously placed wall elements.

In addition to rebar members 28, metal column and roof beam structural steel members as shown in U.S. Pat. No. 4,625,484 may be fastened to the lag screws 26 or nails 26*a*. The outer surface mesh 20 can also be attached to the protruding heads of the male attaching members 26.

The inner surface of the stud 22 can receive either the drywall sheets which may now be nailed directly to the studs, or may have installed thereon sheet metal or wood nailers such as is shown at 34 to which drywall may be attached by conventional methods.

By anchoring the stud to the reinforced concrete structure, the stud will remain in place regardless of the condition of the expanded polystyrene or other synthetic plastic material.

While a presently preferred embodiment of the invention has been illustrated and described, it will be recognized that the invention may be otherwise variously embodied and practiced within the scope of the claims which follow.

What is claimed is:

1. In a building construction of the type having its wall and roof members formed from a plurality of building panels to provide wall panel members and roof panel members each formed from synthetic material having a low melting point, the improvement which comprises:

a. a stud member positioned between adjacent building panel members in contiguous relationship to the side edges of said building panel members, (1) said adjacent building panel members being performed to form conduits between adjacent wall panel members and corresponding roof panel members, b. means for permanently securing said stud member in place between adjacent building panel members including male attaching members secured to said stud members and extending into said conduits, c. rebar members secured to said male attaching members at an abutment member formed on said male attaching members with said male attaching members extending a fixed distance into said conduits to position said rebar members, d. and concrete filling said conduits to provide a reinforced concrete structure.

2. In a building construction as defined in claim 1 wherein said male attaching members are lag screws.

3. In a building construction as defined in claim 1 wherein said male attaching members are nails.

4. In a building construction as defined in claim 1 wherein said male attaching members extend into said conduits established between adjacent panel members to fasten column or roof beam structural steel members thereto.

5. In a building construction as defined in claim 1 wherein outer surface mesh reinforcing are attached to the heads of said male attaching members.

6. In a building construction as defined in claim 1 including furring strip means secured to said stud members and drywall members attached to said furring strip means.

7. In a building construction as defined in claim 1 including gang nail members attached to the lateral sides of said stud members to align the synthetic material of adjacent building panel members.

8. In a building construction as defined in claim 1 including a horizontally disposed plate member along the upper surface of said stud members with said horizontally disposed plate member providing an interconnector between studs of said wall panel members and of said roof panel members.

* * * * *